United States Patent [19]

Hillard

[11] Patent Number: 4,874,167

[45] Date of Patent: Oct. 17, 1989

[54] APPARATUS AND METHOD FOR SIMULATING THE GAME OF GOLF

[76] Inventor: Devere D. Hillard, 1109 N. Valley Rd., Apache Junction, Ariz. 85220

[21] Appl. No.: 253,571

[22] Filed: Oct. 5, 1988

[51] Int. Cl.[4] ..... A63F 7/06; A63D 15/06; A63B 67/02

[52] U.S. Cl. ..... 273/14; 273/87 B; 273/9; 273/176 H; 273/176 F

[58] Field of Search ..... 273/87 R, 87 B, 87 D, 273/123 R, 127 R, 176 R, 8, 9, 2, 3 R–3 A, 14, 178 B, 113, 115, 116, 117, 87 E, 176 AA, 176 AB, 176 B, 176 D, 176 E, 176 F, 176 H, 181 K, 4 B, 5 A

[56] References Cited

U.S. PATENT DOCUMENTS 615,350 12/1898 Fountain ..... 273/4 B 1,813,116 7/1931 Clausen ..... 273/14

3,544,108 12/1970 Bali ..... 273/123 R 3,871,650 3/1975 Casey ..... 273/178 A 3,958,804 5/1976 Godfrey ..... 273/3 A 4,063,728 12/1977 Zemanek ..... 273/5 A

*Primary Examiner*—Edward M. Coven

*Assistant Examiner*—S. Passaniti

*Attorney, Agent, or Firm*—Donald J. Breh

[57] ABSTRACT

An apparatus and method for simulating a game of golf is disclosed. The apparatus includes a plurality of cushion inserts for removable attachment to the cushion of a pool table to change the longitudinal configuration of the cushion perimeter. Methods of play include individual or team play wherein each player in turn directs his playing ball around the modified table using a conventional cue stick and cue ball into each pocket of the modified pool table in a predetermined sequence.

17 Claims, 1 Drawing Sheet

APPARATUS AND METHOD FOR SIMULATING THE GAME OF GOLF

This invention relates to an apparatus and a method for simulating the game of golf. More particularly the invention relates to apparatus for easily converting a conventional pool table into a playing surface for simulating the game of golf.

Table apparatus for simulating the game of golf have been devised including the use of multiple individual tables each defining different golf course fairway and green configurations and single table apparatus including conventional pool tables modified to include either fixed or positionable simulated golf course hazards, tees and greens to create various tortuous paths over which a ball is directed.

Such apparatus are disclosed in U.S. Pat. Nos. 4,114,876, 3,360,365 and 1,875,198. These apparatus, while effective, either require a significant number of relatively small game pieces that must be set up on the playing field of the conventional pool table or cannot be changed in their configuration. These games have certain shortcomings including the likelihood of losing the small game pieces, increased set up time in order to play the game, and in the case of those in which the field of play cannot be changed, increased repetition of play and less challenge and entertainment to the player over time.

SUMMARY OF THE INVENTION

According to the invention there is provided an apparatus that provides for fast, easy conversion of a conventional pool table into a challenging and entertaining field of play of simulated golf requiring very few accessories.

According to the invention, there can be provided a playing surface adapted to be positioned on a conventional pool table or other stand or table which can be made as an integral part of a table.

According to an important feature of the invention there are provided a plurality of cushion inserts having longitudinal curvilinear, resilient portions adapted to be removably positioned against the cushions of a conventional pool table for varying the longitudinal shape of the perimeter of the pool table laying field.

Preferably, there are at least six inserts having at least two different longitudinal shapes for placing at least one insert between each of the six pockets of the conventional pool table.

According to an important feature of the invention each insert is shaped on one side to conform to the cross sectional shape of the pool table cushion and fits snugly thereagainst.

According to another feature, the inserts are weighted to increase their retention to the table.

According to a still further important feature, the playing surface is non-planer to simulate a golf course terrain.

According to a preferred method of play, there is provided a pool table having its perimeter longitudinal shape modifiable, a cue ball and a playing ball for each player, whereby each player in turn directs his playing ball around the field of play into each pocket in a predetermined sequence by propelling the playing ball with the cue ball by striking the cue ball with a conventional pool cue stick.

According to another aspect of the method of play, there is provided a nuisance ball in the field of play.

According to the preferred method of play, the first player to direct his playing ball into each pocket in the predetermined sequence is the winner.

According to another method of play, there are at least two teams of at least two players on each team, whereby the first team to have all players on its team direct their playing balls into each pocket in the predetermined sequence is the winner.

BRIEF DESCRIPTION OF THE DRAWINGS

The invention will be better understood after reading the following Detailed Description of the Preferred Embodiment in conjunction with the drawings of which.

DETAILED DESCRIPTION OF THE PREFERRED EMBODIMENT

Figure 1:
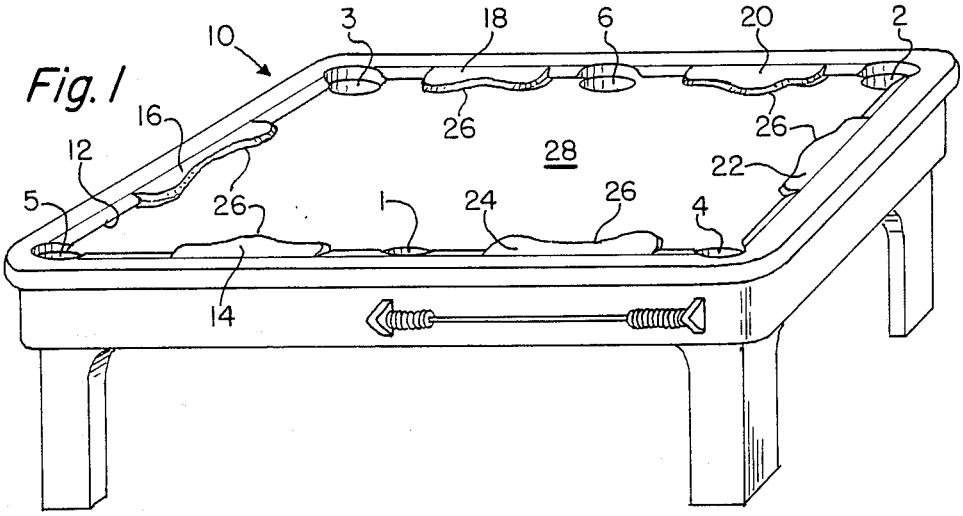
FIG. 1 is a perspective view of a conventional pool table showing the longitudinal configuration of the perimeter of its playing field modified according to the present invention.

Referring to FIG. 1 there is shown a conventional pool table 10 having six ball receiving pockets 1, 2, 3, 4, 5, 6. The pockets, for the purpose of playing the game of simulated golf according to the present invention, are labeled in a predetermined sequence in which a player must direct a playing ball into the pockets. The sequence shown is only representative and can be any order desired to vary the play.

Figure 2:
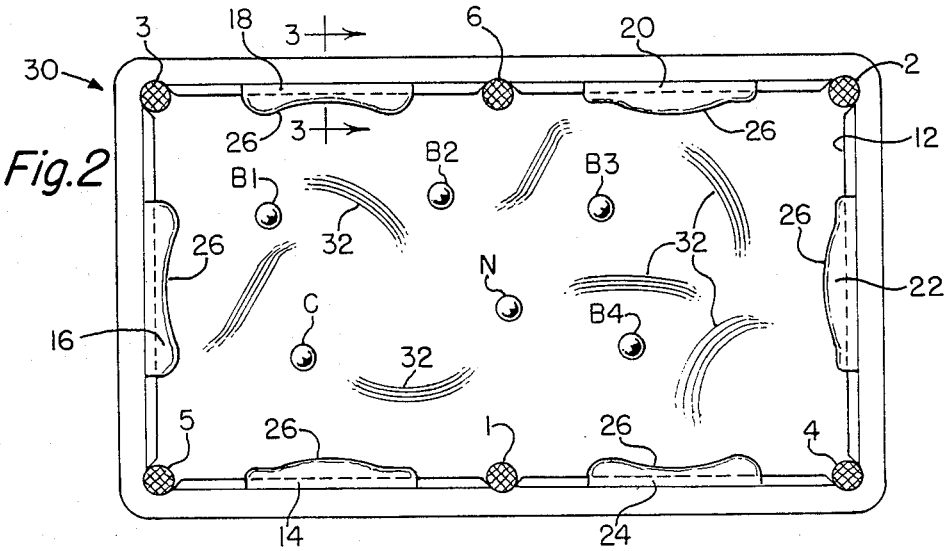
FIG. 2 is a plan view of a table top including an area of play according to the invention.

The pool table 10 includes a conventional cushioned perimeter 12 whose longitudinal configuration is changeable so as to change the shape of the field of play and to introduce interesting and less predictable ball movements of various playing field shapes available. The longitudinal configuration of the perimeter of the pool table is changeable through the removable mounting of different cushion inserts, such as inserts, 14, 16, 18, 20, 22, 24 shown in FIGS. 1 and 2. As shown in FIGS. 1 and 2, there are preferably at least six inserts positioned at spaced intervals with at least one insert positioned between each adjacent pocket. Each insert is provided with a curvilinear longitudinal surface or edge 26 facing into the field of play. The two specific longitudinal shapes shown are representative only and can be any configuration desired. Also more or fewer inserts can be provided for and any number and combination of inserts can be mounted for play as desired. Accordingly, the inserts are made to be easily removable providing for fast easy modification of the shape of the playing field. The playing surface 28 in FIG. 1 is a planer, level surface of a conventional pool table.

Referring to FIG. 2, there is shown in plan view a table top 30 which has a non-planer playing surface 32. For example, the surface can be made slightly wavy, irregular and or undulating in arbitrary directions to simulate a more natural and challenging golf course terrain. Otherwise, the perimeter 12 of the table top is raised and cushioned just as the conventional pool table 10 in FIG. 1 and the perimeter longitudinal shape is also modifiable by the removable cushion inserts 14, 16, 18, 20, 22, 24.

As is evident, the playing surfaces need not be part of a conventional pool table, but rather can be an entirely separately manufactured complete game table having either a planer or non-planer playing surface or can be a separate moveable table top including a desired playing surface for removable positioning on an existing table such as a pool table. Preferably, if a separate table or table top is provided for, it would have dimensions of about 100 inches long by about 54 inches wide and from 6 to 9 pockets. Further, any new table need not be rectangular but could have a contoured perimeter as well.

Figure 3:
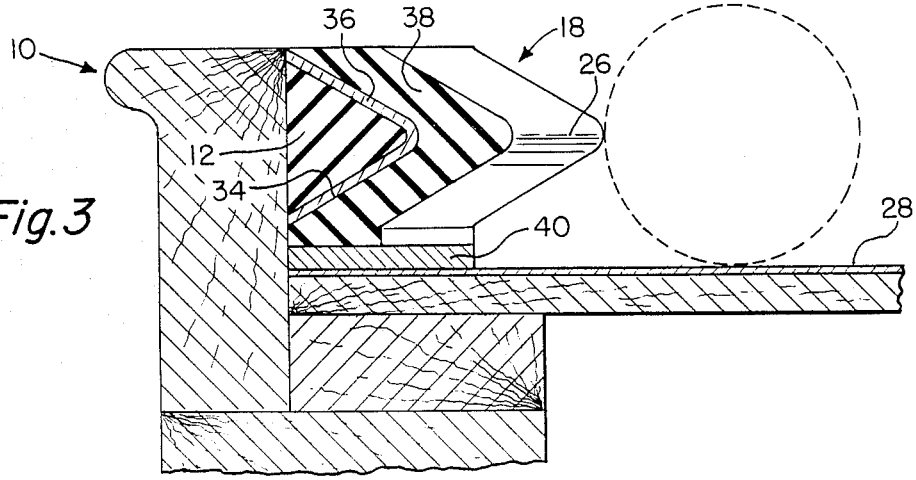
FIG. 3 is a cross sectional view taken along the line 3—3 in FIG. 2 showing details of construction and installation of the cushion inserts according to the invention.

FIG. 3 shows one preferred construction of the cushion inserts, for example insert 14, and is composed of a dense material having good elastic memory and resiliency such as a dense rubber which is configured on one side 34 to conform to the transverse cross sectional shape of the table's cushion or bumper 12. A metallic insert 36 is insert molded to the cushion insert for intimate receipt against the bumper 12. The opposite side of the insert facing the field of play includes a transverse cross sectional shape defining a conventional pool table cushion or bumper 38. If desired, a weight 40 can be affixed to the bottom of the insert to help hold the insert in place during play. Other insert designs are within the skill of the ordinary designer and that shown is representative only.

Many variations in play including the rules of play are possible. Two methods including individual and team play are disclosed herein.

First, in individual play, the shape of the playing field is selected and changed by positioning the inserts at desired locations against the perimeter cushion 12 of the table. The players of which there are from one to preferably four each choose a different playing ball B1, B2, B3, B4 and serially align the balls in chosen order of play on the table at the conventional table break spot. The first player breaks the balls by directing a cue ball C into the aligned playing balls. The players then in turn direct their respective playing balls around the field of play into each pocket in a predetermined order using a conventional cue stick and cue ball using generally conventional pool playing techniques. After sinking his playing ball in one pocket, the player respots his ball and continues playing to sink his ball in the next designated pocket. The object of the game is for each player to be the first to direct his ball into all pockets in the predetermined order.

In team play wherein there would be, for example, two teams of two players each, the first team to have all of its players direct their playing balls into all of the pockets in the predetermined order is the winner.

To increase the level of skill required and to change the character of play, a nuisance ball N can be introduced into the playing area. Events such as, sinking of the nuisance ball, sinking an opponents ball, a scratch, or sinking ones own ball into a pocket out of sequence all may have certain desired adverse affects on the player or team such as for example, loss of that players next turn.

The apparatus and method of play according to the invention provides for stationary or portable, easily set up, interesting and entertaining game of simultated golf by one or more players of average pool playing abilities.

Having described the preferred embodiment of the invention, those skilled in the art can readily devise other embodiments and modifications and such other embodiments and modifications are to be considered to be within the scope of the appended claims.

What is claimed is:

1. A simulated golf game comprising:

a playing surface having a contour and a raised peripherial edge around said playing surface, said raised peripherial edge having a longitudinally contoured resilient portion facing and defining said area of play;

a plurality of ball receiving pockets positioned at spaced apart locations around the peripherial edge opening into said area of play:

means for selectively changing the longitudinal contour of selective sections of said resilient portion of said peripherial edge to selectively change the longitudinal contour of the resilient portion of the peripherial edge to substantially an infinite number of different longitudinal contours providing for selectively changing the area of play into substantially an infinite number of different shapes;

at least one playing ball, and a cueball, whereby at least one player propels said cue ball using a cue stick to strike and direct said playing ball around said area of play into each pocket in a predetermined order.

2. The game as defined in claim 1 wherein the contour of said playing surface is planer.

3. The game as defined in claim 2 wherein said playing surface is defined by a conventional pool table.

4. The game as defined in claim 1 wherein said playing surface is defined by a table top-like member adapted to be removably positioned on top of a conventional pool table.

5. The game as defined in claim 1 wherein said playing surface is an integral part of a table and the contour of said playing surface is non-planer.

6. The game as defined in claim 1 wherein said means for changing the longitudinal contour of the resilient portion of the peripherial edge comprises a plurality of inserts adapted to be removably mounted to said peripherial edge at said selective sections, each insert having a non-linear longitudinally contoured resilient portion facing into the area of play.

7. The game as defined in claim 6 wherein the contour of said playing surface is non-planer.

8. A simulated golf game comprising:

a playing surface surrounded by a resilient cushion defining a playing field;

a plurality of ball receiving pockets opening into said playing field;

a plurality of resilient inserts each having a predetermined longitudinally curvilinearly contoured portion, each insert including means providing for removable mounting to said resilient cushion at different selective positions with said longitudinally curvilinearly contoured portion facing said playing field;

a cue ball; and at least one playing ball, whereby at least one player propels said cue ball using a cue stick to strike and direct said playing ball around said playing field into each pocket in a predetermined order.

9. The game as defined in claim 8 further including a nuisance ball in said playing field.

10. The game as defined in claim 8 wherein each said removable insert comprises a first portion configured for intimate receipt against the resilient cushion and a second portion defining said longitudinally curvilinearly contoured portion.

11. The game as defined in claim 10 wherein said insert includes a weight.

12. The game as defined in claim 10 wherein said insert includes a metallic insert molded at said first portion configured for receipt against the resilient cushion.

13. The game as defined in claim 10 wherein said playing field and resilient cushion are defined by a conventional pool table.

14. A method for at least one player to play simulated golf on a conventional pook table comprising the steps:

a. changing the longitudinal contour of the perimeter cushion of said pool table by mounting at least one cushion insert, which has a non-linear longitudinally contoured resilient portion, against said pool table cushion at at least one selected location along said perimeter;

b. providing a cue ball on said pool table;

c. providing at least one playing ball on said pool table for each player;

d. in turn, each player, using a cue stick, propells the cue ball to strike and direct his playing ball around said pool table into a designated one of the pool table pockets in a predetermined order.

15. The method as defined in claim 14 further comprising the step of providing a nuisance ball on the pool table in addition to the cue ball and said at least one playing ball.

16. The method as defined in claim 14 wherein there are at least two players, the first player to direc this playing ball into each pocket in the predetermined order is a winner.

17. The method as defined in claim 14 wherein there are at least two teams of at least two players on each team, the first team to have all of its players direct their respective playing balls into each pocket in the predetermined order is a winner.

* * * * *